United States Patent [19]

Gass et al.

[11] 4,251,191

[45] Feb. 17, 1981

[54] METHOD FOR LIFTING OIL IN A WELL

[75] Inventors: John C. Gass, Wichita, Kans.; Noell C. Kerr, Liberty; Robert W. Pittman, Sugarland, both of Tex.

[73] Assignee: Texaco Inc., White Plains, N.Y.

[21] Appl. No.: 47,421

[22] Filed: Jun. 11, 1979

Related U.S. Application Data

[63] Continuation-in-part of Ser. No. 889,792, Mar. 23, 1978, abandoned.

[51] Int. Cl.[3] ..... F04F 1/20

[52] U.S. Cl. ..... 417/111; 251/61; 251/129

[58] Field of Search ..... 417/109, 110, 111, 112; 251/61, 129

[56] References Cited

U.S. PATENT DOCUMENTS

| | | | |
|---|---|---|---|
| 2,556,867 | 6/1951 | Carlisle et al. | 417/112 |
| 2,725,014 | 11/1955 | Pryor | 417/111 |
| 2,759,429 | 8/1956 | Bubb | 417/111 |
| 2,869,475 | 1/1959 | Bobo | 417/111 |
| 2,876,434 | 3/1959 | Oberlin | 417/111 X |

*Primary Examiner*—Edward L. Roberts

*Attorney, Agent, or Firm*—Carl G. Ries; Robert A. Kulason; Theron H. Nichols

[57] ABSTRACT

A method for lifting oil from the bottom of a well comprises, (1) injecting a fluid of less specific gravity into the well with a fluid flow control valve, and (2) equalizing the fluid pressure on all sides thereof for making the fluid flow control valve balanced and frictionless as the fluid of less specific gravity is ejected thus requiring a minimum of energy for operation thereof for providing a highly efficient lifting of the oil in the well.

7 Claims, 7 Drawing Figures

METHOD FOR LIFTING OIL IN A WELL

BACKGROUND OF THE INVENTION

This is a continuation-in-part of application Ser. No. 889,792, filed on Mar. 23, 1978, now abandoned.

When the oil in a well ceases to flow from the top of the well due to insufficient pressure in the bottom of the well, the method of "gas lift" may be utilized, i.e., a system for "lifting" fluid, as oil, in a pipe in a well to the surface for oil production by injecting high pressure reservoir gas or inert gas, if available, into the pipe or production tube in the well at some point below the surface, the gas lowers the specific gravity and thus increases the rate of upward flow.

The conventional gas lift valve may be similar to that of FIG. 1, but without the control tube 18, chamber 23, and choked inlet 24. The conventional top valve bellows is usually charged with the highest pressure, as 800 psi, while each succeeding lower bellows valve is charged with a lower pressure, whereby the conventional casing pressure of over 600 psi opens all bellows valves and upon lowering of the casing pressure below 600 psi, FIG. 2, the uppermost valve closes first. Since the downwardly positioned series of conventional gas lift valves open with decreased pressure as the liquid level lowers in the casing annulus around the production tube, continued lowering of the casing pressure thus closes the downward succeeding valves to the lowest valve. This lowest valve is maintained open as lifting is required because this low casing pressure is still slightly greater than the internal bellows valve pressure which holds the valve open.

In the initial stage of start-up of the conventional gas lift well, it is often necessary to unload "kill" fluid, usually water, from the tubing and the tubing-casing annulus to provide space for storage and subsequent admittance of gas into the production tube at the desired depth. After unloading, the desired reservoir fluid, as crude oil, can then enter the bottom of the production tube and be "lifted" to the surface by either continuous gas injection or intermittent gas injection, depending on the method chosen for the particular reservoir conditions present.

Gas lift valves are critical components in the gas lift system. They are used to admit gas or liquid into the production tube from the pressurized casing annulus. Under a predetermined casing annulus pressure, all vertically spaced gas lift valves are opened including the uppermost valve to eject the liquid present in the annulus out of an ejection orifice or nozzle at each valve into the production tube. When all liquids above the uppermost valve are ejected into the production tube, the casing gas thereabove begins to flow through the valve for ejecting into the production tube. With the lowering liquid level arriving below the valve and when gas in place of liquid begins to be ejected, this gas flow is then detected by a decrease in casing pressure and an increase in production tube pressure. In the conventional gas lift system, a choke in the gas inlet line at the top of the well is closed down slightly to limit the gas flow rate and subsequent fluid rate such that as the liquid level continues to drop at a rate low enough to prevent valve port errosion, and the fluid is ejected from the casing annulus to the production tube from the remaining lower valves. As the liquid level reaches and is detected at each successive lower valve, the casing pressure decreases, closing each successive lower valve until the liquid level is below the lowermost valve and gas is then ejected therefrom continuously or intermittently for gas lifting of the reservoir crude oil flowing into the bottom of the production tube. Thus, with or without any malfunction of the gas lift valves, excessive amounts of gas energy are wasted due to dropping the casing pressure at each successive valve in order to close the upper valves. This results in higher gas circulation volumes at lower pressures and reduces the efficiency of recycle compression as the same gas is recycled.

The unsatisfactory results of the above operation of the conventional gas lift valves are:

(1) restricted space available reduces the size and thus force available to stroke the valve;

(2) the conventional metal bellows requires a high pressure nitrogen charge, and also the stiffness of the metal bellows or diaphragm results in the allocation of inefficient casing pressure drops in some cases to obtain the work force to stroke the valve;

(3) small ports are required in the valve to avoid reducing the effectiveness of the closing force of the bellows valve and to avoid reducing the reopening affect of the tubing pressure. Thus, large gas flow rates are not available when they are most needed;

(4) valves with springs for setting the operating pressure have stiffness and increased problems of generating the force required to travel the valve stem;

(5) the control of nitrogen as by the use of a nitrogen charge required as a balancing force adds problems due to temperature effects. In addition, the bellows stiffness is increased when the nitrogen pressure is further compressed as the valve is opened;

(6) as for quality control, it is difficult to insure that the nitrogen charge pressure is accurately set and maintained throughout the installation life of the valve;

(7) so that the upper valves in the above described gas lift valve operation will be maintained closed during normal operation of the well, they must have a higher pressure charge. Available casing pressure is wasted during normal operation to prevent those valves from reopening. With intermittent gas lift operation it is difficult to maintain a steady passage of gas into the tubing without allowing the casing pressure to increase and reopen the upper valves; and (8) the conventional valves operates against a hydraulic or pneumatic force in at least one direction.

OBJECTS OF THE INVENTION

Thus, the principal object of this invention is to provide a method for lifting a fluid in a production tube of a well by controlling the flow of a lifting fluid into the production tube with a remote controlled balanced and frictionless valve at the surface.

Another principal object of this invention is to provide a method for gas lifting oil in an oil well production tube by controlling from the surface the flow of lifting gas injected therein with a balanced valve that equalizes the fluid pressure on all sides thereof for requiring a minimum of energy for operation.

A further object of this invention is to provide a new method for efficiently lifting oil in a well with gas that requires smaller amounts of energy to operate.

A still further object of this invention is to provide a new method for controlling a fluid valve in a gas lift system with a remote control valve at the surface whereby upon the occurrence of a leak in the fluid valve, it will remain open and not close for reliability of uninterrupted fluid flow in the gas lift system.

Still another object of this invention is to provide a method for gas lifting oil in an oil well that is easy to operate, comprises simple method steps, is economical to operate, and has greater efficiency for the raising of oil in an oil production tube from the bottom of a well.

Other objects and various advantages of the disclosed method and balanced valve system for lifting fluids in a well will be apparent from the following detailed description together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, two forms of the invention wherein like reference numerals designate corresponding parts in the several views in which.

The invention disclosed herein, the scope of which being defined in the appended claims is not limited in its application to the details of construction and arrange of parts shown and described, since the invention is capable of other embodiments and of being practiced or carried out in various other ways. Also, it is to be understood that the phraseology or terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

BASIC METHOD OF THE INVENTION

Figure 4:
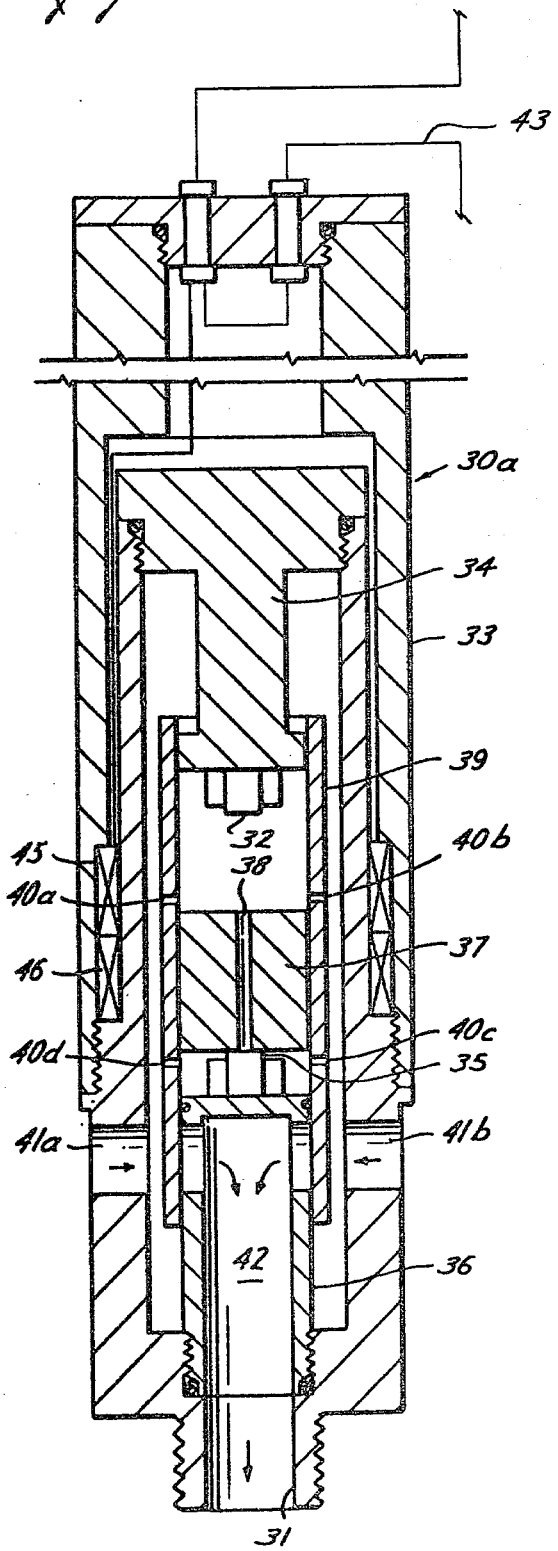
FIG. 4 is a schematic diagrammatical detailed view of a remote electrically controlled balanced gas lift valve.
Figure 5:
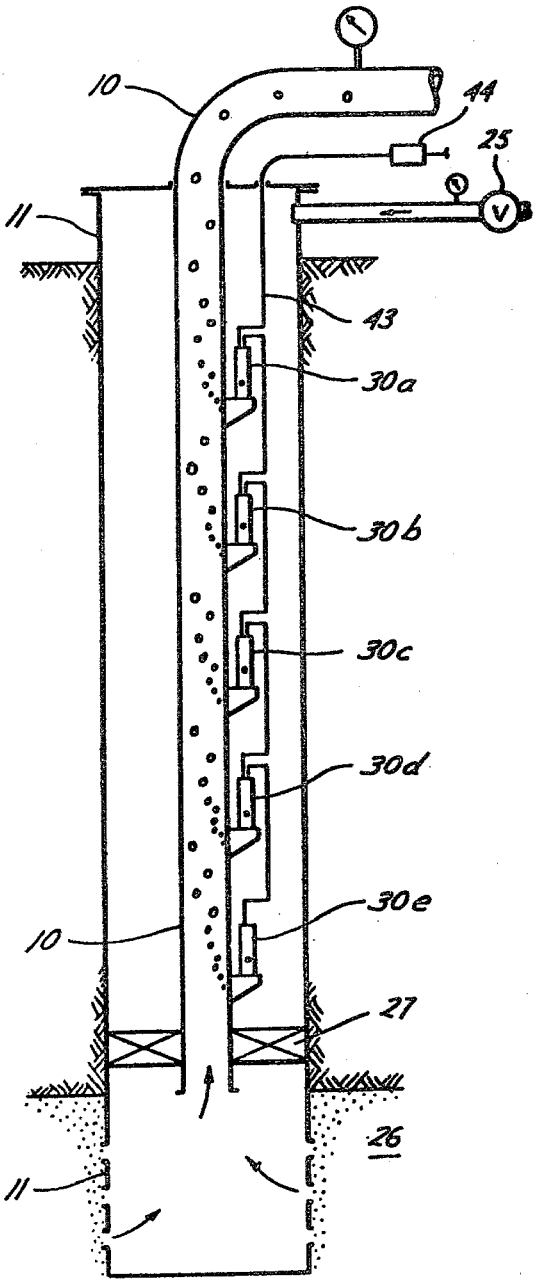
FIG. 5 is a schematic diagrammatical view of a plurality of interconnected remote electrically controlled gas lift valves mounted on a production tube in a well.

A basic method is disclosed for lifting oil or other hydrocarbons from the bottom of a well that has insufficient pressure to cause the oil to flow freely from the production tube in the well wherein the production tube has a passage (22–24, FIG. 1 or 41–42, FIG. 4) for casing fluid to flow into the production tube and the passage has therein fluid valve means (13, FIG. 1 or 39, FIG. 4) comprising the method steps of, (1) controlling a balanced and frictionless fluid valve 30*a*, FIG. 5 with a remote valve control means (44) at the surface for opening and closing the fluid valve in a predetermined sequence for injection of casing fluids into the production tube for lifting the oil in the production tube, and (2) controlling the balanced and frictionless fluid valve further with the remote valve control by providing means in the fluid valve for equalizing the fluid pressure on all sides thereof for thus requiring a minimum of energy for operation thereof for providing a highly efficient lifting of oil in the well.

METHOD PERFORMED BY GAS LIFT VALVE OF FIGS. 4–7

A method of lifting oil in a well wherein a production tube centered in the well casing has a plurality of vertically spaced passages (41–42, FIG. 4) for fluid, as a gas, to flow from the casing into the production tube and an electromagnetically actuated balanced and frictionless valve means (30*a*–30*e*, FIG. 5) positioned in each passage comprising the method steps of, (1) controlling each of the vertically spaced balanced and frictionless electromagnetically actuated valve means responsive to a remote electronic switch (44, FIG. 5) at the surface for opening and closing the valve means in any desired predetermined sequence for ejecting gas or fluid from the casing through the vertically spaced passages into the production tube at the predetermined levels in the well by providing means in the valve means for equalizing the fluid pressure on all sides thereof for requiring a minimum of energy for operation thereof for thus producing a highly efficient lifting of oil in the well.

EMBODIMENT FOR PRACTICING THE INVENTION

The above methods for lifting oil in an oil well may be performed by other mechanisms than those disclosed in the drawings. The mechanisms or valves herein may be operated by other methods than those disclosed above, as by hand. However, the two preferred valve systems for performing the above methods are disclosed hereinafter.

REMOTELY ACTUATED GAS LIFT FLUID VALVE OF FIGS. 1–3

Figure 1:
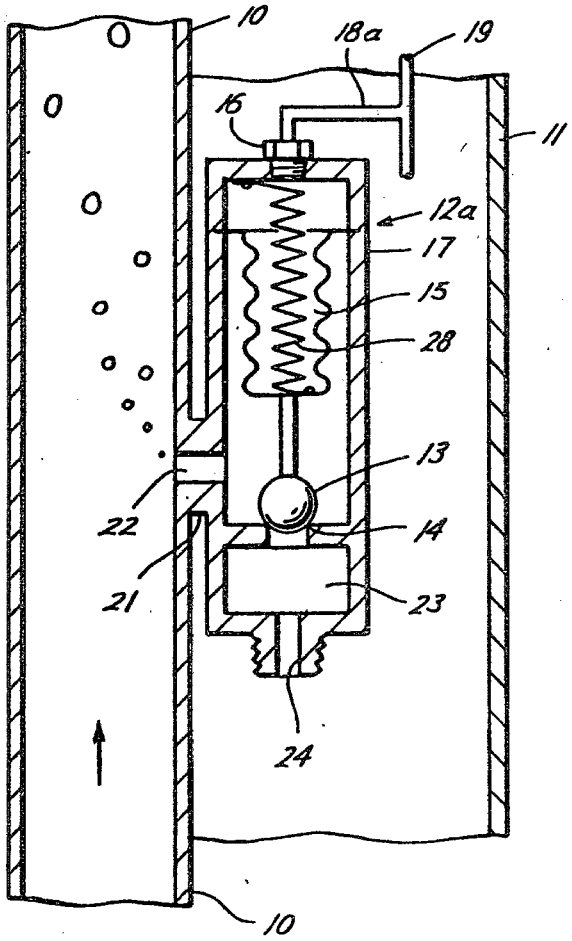
FIG. 1 is a schematic diagrammatical detailed view of a remote fluid controlled mechanical gas lift valve.

The fluid actuated valve disclosed in FIG. 1 which is mounted on production tube 10 in the well casing 11 is a fluid or gas lift actuated bellows valve 12. It comprising ball valve 13 vertically actuated in valve seat 14 by bellows 15 which is expandable and contractable by a fluid, such as but not limited to, air or natural gas flowing through control tubing tee 16 in housing 17 from a lateral control tube 18 connected to a main line 19 extending up to a conventional manual fluid pressure control panel or remote valve control means 20, FIG. 2, at the surface. The housing 17, FIG. 1, is attached to the production tube 10 with a conventional securing attachment 21 having an orifice or nozzle 22 for ejecting casing fluid into the production tube. An entrance chamber 23 is formed outside of the valve and valve seat, 13, 14, respectively, with a choked inlet 24 for lowering the pressure in the chamber 23 when flow therethrough is established.

Since fluid flow is usually from the casing annulus around the production tube, through the gas lift valve, and then into the production tube, the pressure in the production tube is less than that in the casing. Accordingly, the control fluid pressure in the bellow is thus working against the lower production tubing pressure instead of working against the higher casing pressure as in the conventional gas lift valve. Thus, expansion of the bellows working against the production tube pressure lowers and closes valve 13 on its seat 14 and contraction of the bellows working with the production tube pressure and casing pressure opens valve 13 as controlled by the fluid pressure introduced from lateral control tube 18 from the surface.

While a tension spring 28 internally of the bellows 15 normally urges the valve 13 off its seat 14, fluid pressure in the bellows seat the valve, as controlled from lateral fluid pressure control tube 18.

While an inert gas as nitrogen is the preferred operating fluid in the fluid actuated bellows valve, other gases or liquids may be utilized as natural gas from the well, air, water, etc. All parts that form the new fluid valve are conventional parts.

Figure 2:
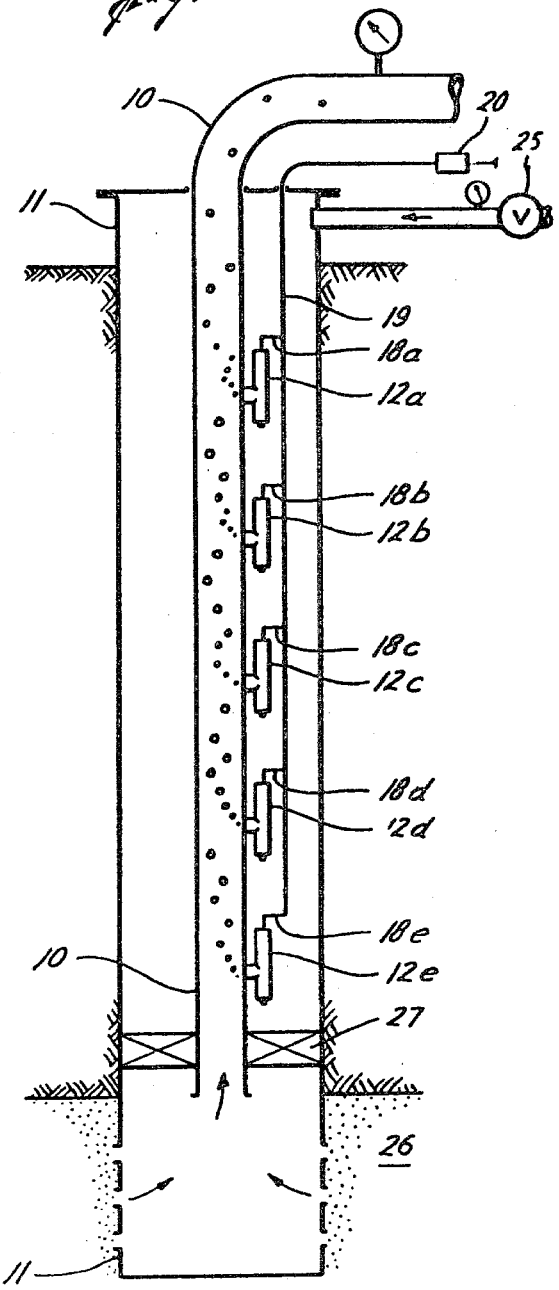
FIG. 2 is a schematic diagrammatical view of a plurality of interconnected mechanical remote fluid controlled gas lift valves mounted on a production tube in a well.

FIG. 2 discloses the production tube 10 with a plurality of vertically spaced fluid actuated bellows valves attached thereto. While individual control tubes may extend from each fluid actuated bellows valve up to the fluid pressure control panel 20 at the surface for providing individual control of the fluid actuated bellows valves for one embodiment of the invention, another, different, and preferred fluid control system is disclosed in FIG. 2.

The fluid actuated bellows valve control system of FIG. 2 comprises a main controllable, pressure line 19, preferably a nitrogen line extending down in the well casing 11 from the gas or nitrogen pressure control valve panel 20 at the surface. Lateral gas lines 18*a*, 18*b*, 18*c*, 18*d*, and 18*e* are connected with tubing tees between the main controllable pressure line 19 and each gas actuated bellows valve 12*a*, 12*b*, 12*c*, 12*d*, and 12*e*, respectively. The standard field gas pressure source 25 pressurizes the casing head, such as between 600 psi and 1000 psi.

Figure 3:
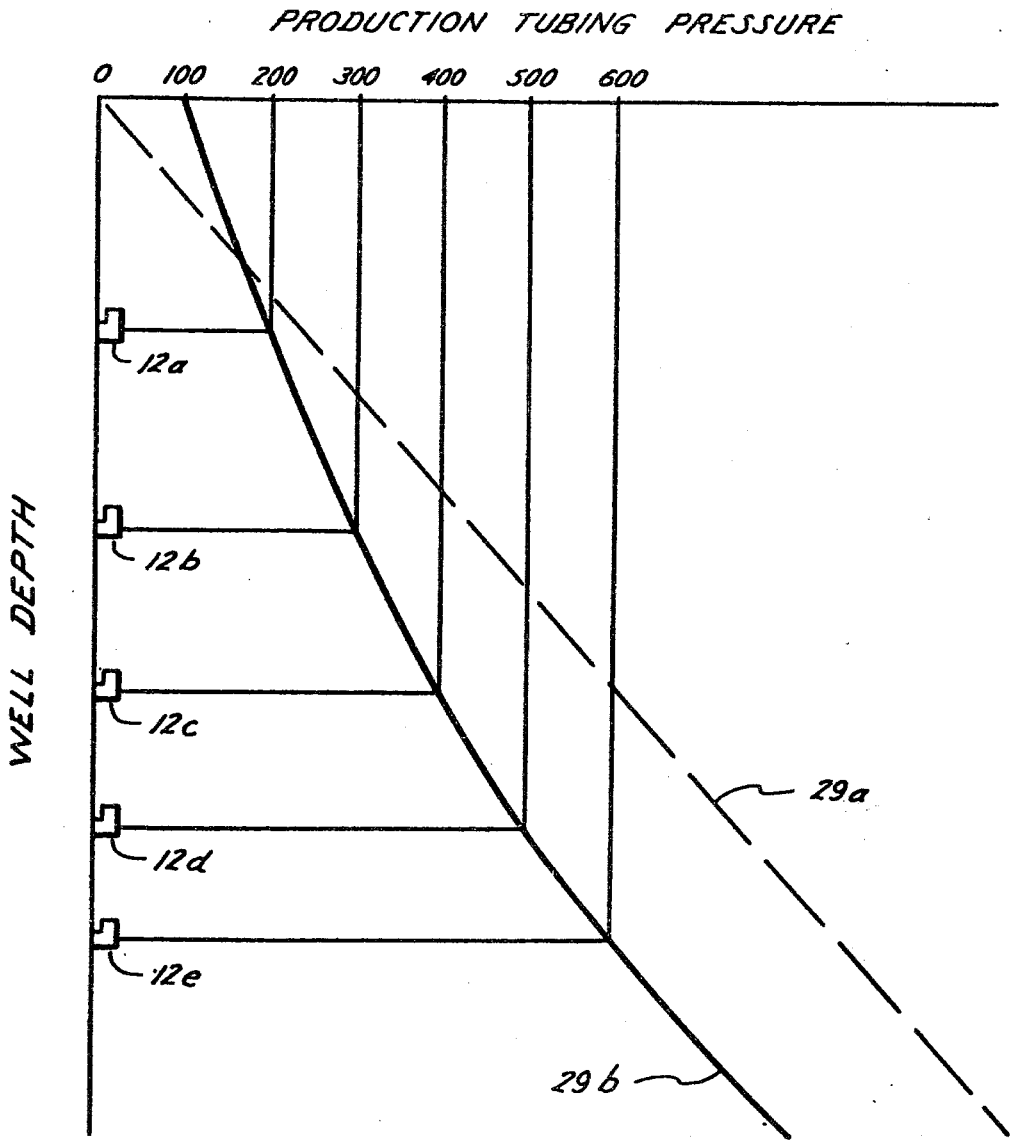
FIG. 3 is a pressure versus depth set of curves for a gas lift oil well.

FIG. 3 is a "pressure versus depth" set of curves for a gas operated gas lift oil well. The broken line or bottom hole pressure static line 29*a* represents the relationship of the pressure with depth in a static well where there is no flow therein. The curved line or bottom hole pressure flowing line 29*b* illustrates the variation of pressure with depth in the production tube of a flowing well due to gas lift with a small pressure, as 100 psi, (7.03 Kg. per sq. cm.) applied to the top of the production tube at the surface, or tubing pressure at well head.

In a plane cartesian coordinate system, the absissa is fluid pressure in the well in psi (Kg. per sq.cm.) and the ordinate is depth in feet (meters).

Each gas lift valve of the above example is positioned on the production tube and spaced in depth at 100 psi (7 Kg. per sq. cm.) intervals for ease of illustration and computation.

| GAS LIFT VALVE | CLOSING PRESSURE |
|---|---|
| 12a | 200 psi.(14.06 Kg. per cm.) |
| 12b | 300 psi.(21.09 Kg. per cm.) |
| 12c | 400 psi.(28.12 Kg. per cm.) |
| 12d | 500 psi.(35.15 Kg. per cm.) |
| 12e | 600 psi.(42.18 Kg. per cm.) |

All gas lift valves are identical, a typical valve being the bellows valve illustrated in FIG. 1 and will open with a slightly greater than 200 psi fluid pressure in its housing 17 externally of the bellows.

In the embodiment of FIGS. 1–3 wherein the illustrated well is usually full of "kill" liquid, the first valve is held open by the liquid hydrostatic pressure or head in the casing of at least slightly more than 200 psi. While the casing pressure is always maintained greater than the production tube pressure, the valve housing is maintained pressurized by either the casing pressure or, when the valve is closed, by the production tube pressure. As the hydrostatic pressure increases toward the bottom of the well, each succeeding valve downwardly requires a higher control pressure from the control line to oppose the casing pressure and extend the bellows to lower and close valve 13, FIG. 1.

While the valves 12*a*–12*e*, FIG. 2, may be designed with a different closing pressure required in each, here they are all shown being identical. Thus, each valve, going down from 12*a* to 12*e*, FIG. 3, requires a 100 psi higher closing pressure in its control line 18 since each succeeding valve is positioned deeper by an amount which increases the hydraulic pressure by 100 psi.

In operation of the embodiment of FIGS. 1–2, as the change over from ejecting casing liquid to casing gas to the production tube by top gas lift valve 12*a*, FIG. 2, is detected at the surface, the control line pressure is increased to slightly over 200 psi to close the uppermost valve, save gas, and continue ejecting "kill" fluid from the casing until the liquid level reaches the second valve 12*b* where the closing pressure is 300 psi. This changeover is detected by a decrease in casing pressure and an increase in production tube pressure.

Upon detection either one or both of these two pressure changes at the surface, main pressure conventional control panel 20, FIG. 2, is then operated (either manually or automatically) to increase the control gas pressure in main line 19 and to all lateral lines 18.

Upon detection of the casing liquid level lowering past this second valve 12*b*, FIG. 2, the control line pressure is increased to slightly greater than 300 psi to close it and continue the ejection of the casing liquid from the remaining valves. Thus, as the casing liquid level reaches the third valve 12*c*, the control pressure is raised to slightly over 400 psi to close it and as the casing liquid level reaches the fourth valve 12*d*, the control pressure is raised to slightly over 500 psi. Then as the remaining "kill" fluid is ejected from the well and only gas is being ejected from the bottom or fifth gas lift valve 12*e*, the control pressure in main control line 19 is maintained slightly under 600 psi to ensure gas flow into the production tube from the bottom of the well or at least from the level of the lowest gas lift valve and all upper valves are held tightly closed by the continued increase in control pressure. When the valve 13 is closed, production tube pressure exists inside the valve housing 17 underneath the bellows and would reopen the valve in the absence of the control pressure in the bellows which maintains the valve closed.

This ejection of the casing head gas is controlled by the surface pressure control source 25, FIG. 2, to either continuous gas injection or intermittent gas injection, depending on the method chosen for the particular reservoir conditions present. The oil thus flows through the perforated casing 11, FIG. 2 at the bottom of the well from the petroliferous formation 26 up into the bottom of the production tube 10 having a packer 27 therearound. Continued upward flow of the oil is enhanced with the injection of the lifting gas into the production tube from the valve 12*e* for decreasing the specific gravity of the oil in the well production tube.

Thus, with the gas pressure in the main controllable pressure line 19, FIG. 2, maintained at just below 600 psi, the closing pressure of fluid actuated bellows gas lift valve 12*e*, being 600 psi, for example, by manual gas pressure control panel 20, lifting gas is ejected from only the gas actuated gas lift valve 12*e*. Then with varying, as by lowering and raising, of the pressure in the main controllable pressure line 19, the several gas actuated valves may be opened in sequence from gas actuated valve 12*e* up to gas actuated valve 12*a*, and closed in sequence back down to gas actuated valve 12*e* at the bottom of the well production tube.

Accordingly, as the well is unloaded the control pressure to the bellows must be increased to surpass the production tubing pressure at the valve location. Once the gas actuated valves are closed down to the lowest or operating valve, closure can be maintained with a pressure magnitude somewhere between the casing pressure and the production tubing pressure. A feature to be noted is that since the control pressure will be lower than the casing pressure, a leak in the control pressure line does not prevent operation by closing any valves, but instead it maintains the valves open. Since once the fluid pressure in the control line 19 reaches and equalizes with that of the surrounding fluid in the casing due to a leak in the line for example, the tension spring 28 normally urges the valve 13 off its seat 14 as described hereinbefore. Because the casing head pressure is usually between 600 psi and 1000 psi, it is normally higher than the 200 psi to 600 psi control line pressure. Thus, the control pressure indication at the surface increases under conditions where leakage occurs and control is then maintained by bleeding the excess pressure in the control line to positively insure opening of the valve 13. Likewise, if valves reopen due to a buildup in production tubing pressure, they can be closed by increasing the control line pressure.

Again, while a separate gas or pneumatic line may be run to each remotely gas actuated gas lift fluid valve 12*a* to 12*e*, FIG. 2, for example, from the main fluid pressure control panel at the surface, the above described sequential control system is preferred for the fluid operated valve modification which operates from a single main controllable pressure line, instead of from a multiplicity of control lines in the well.

REMOTELY ACTUATED BALANCED GAS LIFT ELECTRONIC VALVE OF FIGS. 4–7

FIGS. 4–7 disclose schematically a remote actuated gas lift electronically operated balanced valve 30*a*, FIG. 4, the top valve of a series of valves. The valve 30*a* is attached to the well production tube 10, FIG. 6, in casing 11 for ejecting casing fluid to the production tube from orific or nozzle 31.

Figure 6:
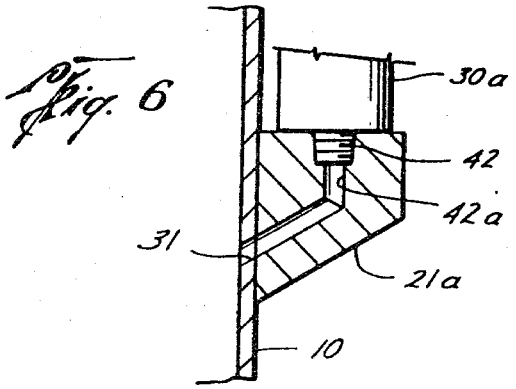
FIG. 6 is a schematic diagrammatic view of a mounting for each of the balanced valves of FIG. 4 on the production tube.

The gas lift electronic balanced valve 30*a*, FIG. 4, comprises an upper permanent magnet 32 mounted in the upper end of valve housing 33 with an upper magnet mounting 34 and a lower permanent magnet 35 mounted in the lower end of the valve housing with a lower magnet mounting 36. An iron core 37 with air vent passage 38 therethrough is securely fastened internally of a sliding sleeve valve 39 slideable between the two permeanent magnets 32 and 35 on portions of the respective magnet mounting 34 and 35. Sliding sleeve valve 39 also has air vent passages 40*a*, 40*b*, 40*c* and 40*d* so that upon movement of the sliding sleeve and the iron core attached thereto the two extreme positions where the iron core is against either the upper permanent magnet 32 or the lower permanent 35, the air trapped in the sliding sleeve may escape with substantially no resistance to sliding movement of the sleeve between the two permanent magnets. These air vents 38, 40*a*, 40*b*, 40*c* and 40*d* ensure a free moving, balanced, and frictionless gas lift valve which expends a minimum of energy for operation in contrast to the conventional valve which operates against hydraulic, pneumatic or spring pressures. When the sliding balanced sleeve 39 is raised to open position (not shown), liquid or fluid from the casing under casing head pressure enters both inlet parts 41*a* and 41*b*, FIG. 4, passes through central conduit 42 when sleeve valve 39 is raised to open position, through conduit 42*a*, FIG. 6, in mounting 21*a* to eject from nozzle 31 in the production tube 10. Mounting 21*a* supporting the electronically operated valve 30*a* on the production tube as illustrated in FIG. 6.

Figure 7:
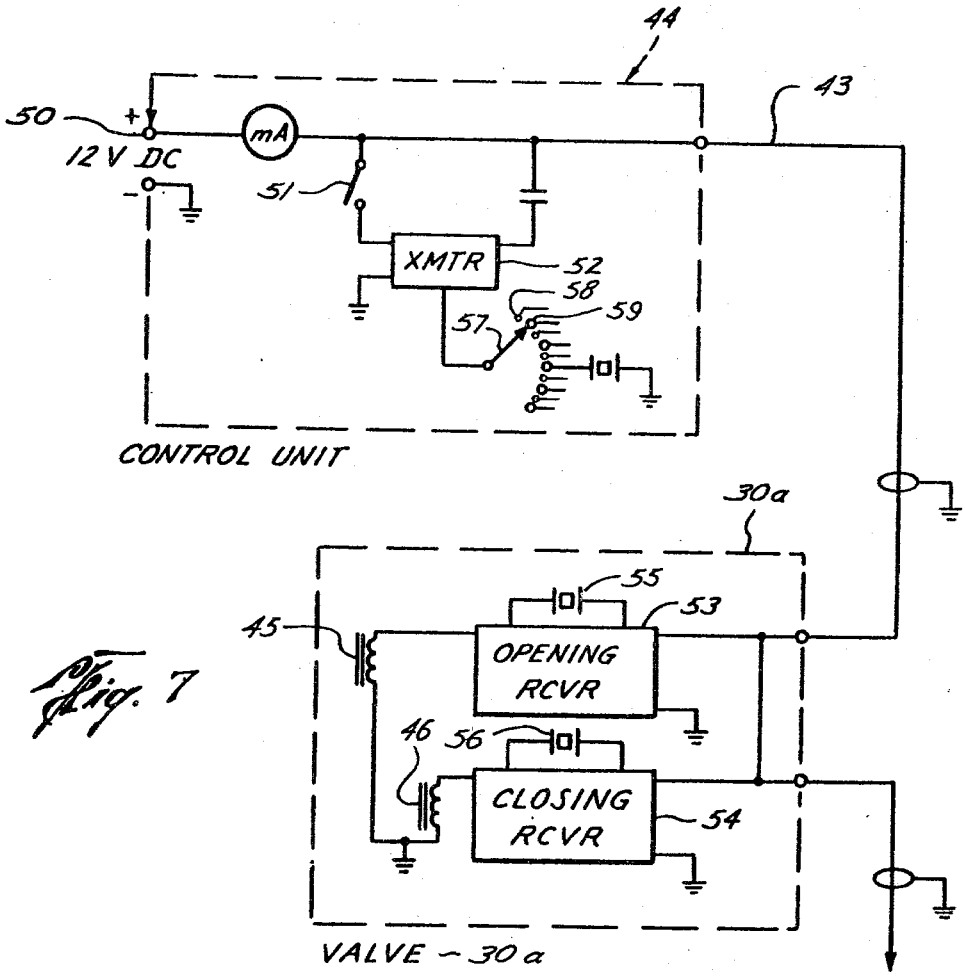
FIG. 7 is a schematic electrical diagram of the remote electrical control system for controlling the valve of FIG. 3 and balanced valves of FIG. 4.

Cable 43, FIG. 4, preferably a single wire, extends from a conventional manual electronic switch panel or remote valve control means 44, FIGS. 5 and 7, down into the well to each remotely actuated gas lift electronically operated valve in series starting with the upper electronically operated valve 30*a*, FIGS. 4, 5, and 7, down to the bottom electronically operated valve 30*e*, FIG. 5. This cable 43 carries the operating power and radio frequency signals of valve 30*a*, for supplying current to solenoid electromagnet windings 45 and 46, FIG. 4, for example, after reception of the proper frequency signal which energizes the desired or proper electronically operated valve for actuation to either closed or open position. In valve 30*a*, FIG. 4, the energizing of upper electromagnet winding 45 causes the iron core 37 to more upward and thus pull the sliding sleeve valve 39 upward to thus open casing fluid ports 41*a* and 41*b*. After the iron core 37 moves its full limited distance and contacts the upper permanent magnet 32, the current may be cut off as the permanent magnet retains the iron core against it to maintain the valve open. The valve is closed in a similar manner by energizing the lower winding 46. Since the sliding sleeve valve 39 is completely surrounded by equal pressure casing fluid, there is no pressure imbalance force for the electromagnet to overcome as in the conventional valve. The conventional switch panel may be manually operated to open one or more valves in sequence, as desired.

FIG. 7 discloses the electrical diagram for the remotely actuated balanced gas lift electronic valves 30*a*–30*e*, FIG. 5, with pressure relieving and balancing vents 38 and 40*a*–40*d*, noting in particular valve 30*a* illustrated in FIG. 4. A 12 volt dc current, or the like power supply is supplied to terminal 50, FIG. 7, on cable 43 extending down to each of the electronically operated, balanced valves 30*a*–30*e* in series down the well for powering the electromagnet windings of each valve. If voltage drop due to cable length is too great, a high voltage AC may be used for power. Likewise, at the surface a transmitter 52 in the control panel 44 is connected to the cable 43 for sending a radio frequency signal of a particular and different frequency for each electronically operated valve, as desired. Each winding is connected to a receiver tuned to a separate matching frequency. Reception of a particular frequency signal energizes the winding of that particular electronically operated valve.

The power line 43, FIG. 7, on which the radio control signals are imposed is illustrated passing through remotely actuated gas lift electronically operated valve 30*a*, for example. Thus, upon transmission of a radio frequency signal to open electronically operated valve 30a from a frequency control dial 54 of the radio signal transmitter 52 at the surface, only the valve opening receiver 53 on valve 30a is responsive to that particular frequency for energizing upper electromagnet windings 45, FIGS. 7 and 4, for moving sliding valve sleeve 39 upwardly to open position. Thus when the resonate frequency of tuned crystal 55 is generated by the transmitter 52, then the solenoid 45 is momentarily energized just long enough for the balanced valve 39 of electronic gas lift gas 30a to move from closed position to open position where it is held open with permanent magnet 32. Flow of casing fluid into the production tube 10 is then commenced. When closing of the balanced valve 30a is desired, another radio signal of a different frequency is transmitted from the surface control panel transmitter 52, FIG. 7, to a tuned crystal 56 of a valve closing receiver 54. Electromagnet windings 46, FIG. 4, are then momentarily energized to actuate the iron core 37 and sliding sleeve valve 39 downward to closed position, and held in closed position with permanent magnet 35. Fluid flow from the casing to the production tube through valve 30a is then ceased.

Accordingly every other small electrical contact, as 58, connects the dial 57 to a valve opening receiver, as 53, and the large contacts, as 59 connect the dial 57 to a valve closing receiver 54. Switch 51 is closed only after frequency control dial 57 is positioned on the desired electrical contact.

Obviously other valves may be utilized in a gas lift system for forming the embodiments of either FIG. 1 or FIG. 4 than those illustrated above, depending on the particular reservoir conditions present.

Accordingly, it will be seen that at least one embodiment of a balanced gas lift control valve has been described and illustrated which will operate in a manner which meets each of the objects set forth hereinbefore.

While only two mechanisms of the invention have been disclosed, it will be evident that various other modifications are possible in the arrangement and construction of the disclosed gas lift control valves without departing from the scope of the invention and it is accordingly desired to comprehend within the purview of this invention such modifications as may be considered to fall within the scope of the appended claims.

We claim:

1. A continuous flow gas-lift method of producing a well having insufficient reservoir pressure to cause produced fluid to reach the surface unaided comprising the steps of, (a) injecting a fluid of less specific gravity into the well with a fluid flow control valve, and (b) passing the fluid simultaneously through and around the fluid flow control valve for making it frictionless by balancing the fluid pressure on all sides of the fluid flow control valve requiring a minimum of energy for operation of the frictionless balanced valve for providing more efficient continuous well fluid production.

2. A method of lifting fluid in a well casing wherein a production tube in the well casing has a passage for casing fluid to flow into the production tube and a fluid flow control valve is positioned in the passage comprising the method steps of, (a) injecting a fluid of less specific gravity into the well with a fluid flow control valve, and (b) balancing the casing fluid flow control valve for making it substantially frictionless requiring a minimum of energy for operation thereof for providing more efficient well fluid production.

3. In a method of lifting oil in a well wherein a production tube centered in the well casing has a plurality of passages for casing fluid to flow into the production tube and a valve means positioned in each passage for ejecting a casing fluid of less specific gravity than oil into the well comprising the additional method step of, (a) balancing the fluid flow control valve means to a substantially frictionless state requiring a minimum of energy for operation thereof for providing improved efficient well fluid production.

4. A method as recited in claim 3 wherein, the step comprises further, (a) balancing the valve means by passing the casing fluid through a plurality of fluid vents in the sides of the valve means as the valve means controls the fluid flow into the production tube for providing more efficient lifting of oil in the well.

5. A method of lifting fluid in a production tube positioned internally of the casing of an oil well, the production tube having a plurality of vertically spaced passages for a fluid to flow from the casing into the production tube and a fluid flow control valve means positioned in each passage comprising the method steps of, (a) injecting a fluid of less specific gravity into the well with a plurality of fluid flow control valve means, and (b) equalizing the fluid pressure around all sides and both ends of each of the fluid flow control valve means for reducing resistance to valve movement for requiring a minimum of energy for operation for more efficient lifting of oil in the production tube of the well, and passage of the lifting fluid from the casing to the production tube for efficiently lifting oil in the well.

6. A method as recited in claim 5 comprising further, (a) injecting the fluid of less specific gravity into the well by controlling an open end slideable sleeve electromagnetically operated valve means on the production tube in the well responsive to the remote actuated control panel at the surface for injecting casing gas into the production tube for raising liquids therein with a minimum of energy required for valve operation.

7. A method of lifting oil from the bottom of a well wherein a production tube is positioned in the well casing forming an annulus therearound in the well with a plurality of vertically spaced passages for a gas to flow from the annulus into the production tube for raising oil from the bottom of the well to the surface and an electromagnetically actuated valve means positioned in each passage comprising the method steps of, (a) ejecting the gas from the annulus through the vertically spaced passages into the production tube at predetermined levels in the well by controlling each of the vertically spaced electromagnetically actuated valve means responsive to a remote electronic switch panel at the surface for opening the plurality of valve means in any predetermined sequence, (b) ceasing the flow of casing gas to the production tube for efficient lifting of oil in the well by controlling further each of the vertically spaced electromagnetically actuated valve means responsive to the remote electronic switch panel for closing the plurality of valve means in any predetermined sequence, and (c) equalizing the fluid pressure on all sides of the valve means for reducing resistance to movement and for providing a balanced valve means requiring a minimum of energy for operation thereof for lifting oil in the well.

* * * * *